US011813545B2

(12) United States Patent
Abarzua-Kocking

(10) Patent No.: US 11,813,545 B2
(45) Date of Patent: Nov. 14, 2023

(54) UNIQUE FLYING DISK WITH A HANDLE AT THE CENTER DOWNWARDS

(76) Inventor: Evans Walter Abarzua-Kocking, Aurora, CO (US)

( * ) Notice: Subject to any disclaimer, the term of this patent is extended or adjusted under 35 U.S.C. 154(b) by 0 days.

(21) Appl. No.: 13/362,855

(22) Filed: Feb. 27, 2012

(65) Prior Publication Data

US 2013/0225032 A1 Aug. 29, 2013

(51) Int. Cl.

| | |
|---|---|
| ***A63H 33/18*** | (2006.01) |
| *A63H 33/22* | (2006.01) |
| *A63H 5/00* | (2006.01) |

(52) U.S. Cl.

CPC ..... *A63H 33/18* (2013.01); *A63H 5/00* (2013.01); *A63H 33/22* (2013.01)

(58) Field of Classification Search

CPC ..... A63H 27/00; A63H 33/18; A63B 65/10
USPC ..... 446/46–48
See application file for complete search history.

(56) References Cited

U.S. PATENT DOCUMENTS 3,015,907 A * 1/1962 Fasano ..... A63H 33/02 446/266
3,082,572 A * 3/1963 Knox, Jr. ..... A63H 27/12 473/589
3,507,497 A * 4/1970 Gardner ..... A63B 65/08 473/590
3,802,117 A * 4/1974 Engelhardt ..... 446/46
3,814,431 A * 6/1974 Callahan ..... A63B 65/08 473/590
3,955,817 A * 5/1976 Davis ..... A63B 65/08 473/589
4,134,229 A * 1/1979 Lehman ..... A63H 33/18 446/47
4,216,962 A * 8/1980 Flemming ..... A63B 65/08 403/252
4,253,269 A * 3/1981 Sullivan ..... 446/46
4,337,950 A * 7/1982 Gidge ..... A63B 65/08 473/588
4,600,398 A * 7/1986 Fraga ..... A63H 1/02 446/46
5,055,080 A * 10/1991 Cwalinski ..... A63H 33/18 446/46
5,181,876 A * 1/1993 Chen ..... A63H 1/00 446/256
5,609,509 A * 3/1997 Stamos ..... A63H 33/18 40/433

(Continued)

FOREIGN PATENT DOCUMENTS

CN 2461604 Y * 11/2001
GB 2417003 A * 2/2006 ..... A63H 27/12

*Primary Examiner* — Eugene L Kim
*Assistant Examiner* — Alyssa M Hylinski

(57) ABSTRACT

This is a flying disk with a handle at the center downwards. Having the handle at the center makes it easy to catch, makes it unique, and gives this flying disk better stability and makes it fun for everyone. The basic shape is a flying disk with a handle at the center downwards. But it can come in many sizes and shapes. It can be made out of different plastics and materials and in different colors. Also, the handle part can be used to put lights so it glows in the dark, it can make sounds, etc. This flying disk can be thrown like a regular flying disk or by the handle. The receiver can catch it like a regular flying disk or by the handle. You can even catch it and it will still keep spinning on your hand. It can spin on the grown like a top.

1 Claim, 4 Drawing Sheets

INSIDE VIEW

(56) References Cited

U.S. PATENT DOCUMENTS

| | | | | | |
|---|---|---|---|---|---|
| 5,906,529 | A * | 5/1999 | Spais | A63B 65/08 | 473/590 |
| 5,934,966 | A * | 8/1999 | Ward | A63B 65/10 | 473/588 |
| 6,106,355 | A * | 8/2000 | Hoerner | A63H 33/18 | 473/588 |
| 7,766,718 | B2 * | 8/2010 | Rago | A63H 1/24 | 446/485 |
| 8,123,585 | B1 * | 2/2012 | Strong | A63H 1/10 | 446/259 |
| 8,454,405 | B2 * | 6/2013 | Scarborough | A63H 27/00 | 446/61 |
| 11,612,828 | B2 * | 3/2023 | Kocking | A63H 33/18 | 446/46 |
| 2006/0052162 | A1 * | 3/2006 | Soukup | G07F 17/3258 | 463/27 |
| 2007/0044728 | A1 * | 3/2007 | Block | A01K 15/025 | 119/707 |
| 2008/0125001 | A1 * | 5/2008 | Barniak | A63H 33/18 | 446/46 |
| 2010/0279579 | A1 * | 11/2010 | Michelsen | A63H 33/18 | 446/46 |
| 2013/0109265 | A1 * | 5/2013 | Lang | A63H 33/18 | 446/46 |

* cited by examiner

TOP VIEW

FRONT VIEW
TAPERED HANDLE

THE FLYING MUSHROOM
EVANS W. ABARZUA

UNIQUE FLYING DISK WITH A HANDLE AT THE CENTER DOWNWARDS

BACKGROUND HISTORY

My invention is a type of flying disk. The flying disk was invented in the 20$^{th}$ Century by a man of last name Frisbee. The shape of the disk is similar to a flying saucer. The disk was made out of plastic of the time. My flying disk has a handle at the center downwards which makes it unique. One time my brother in law threw me a piece of furniture which was a wood disk that had a stick at the bottom and a stick at the top like a wheel with two axels. I realized that something could be invented with this so I went to work. First I realized that the top stick had to be eliminated. Then I put the right handle that had to be smooth. Finally, I put a regular flying disk together with handle at the center downwards and it flew from my hands for the first time in Denver Colorado at Rosamond Park on Quincy and DTC Blvd. I was so happy and I (Evans Walter Abarzua) was the only inventor.

SUMMARY

My inventions is a type of flying disk with the advantage of having a handle at the center pointing downwards, which gives it better stability, ability to do tricks, and has the tendency to recover and land up right. Also the handle makes it easy to catch. It can even be thrown by the handle. Also with this handle it can keep spinning on your hand and acts like a top. So it is very simple, it's a flying disk with a handle at the center downwards.

SPECIFICATIONS OF INVENTION

Details of Invention

Figure 1:
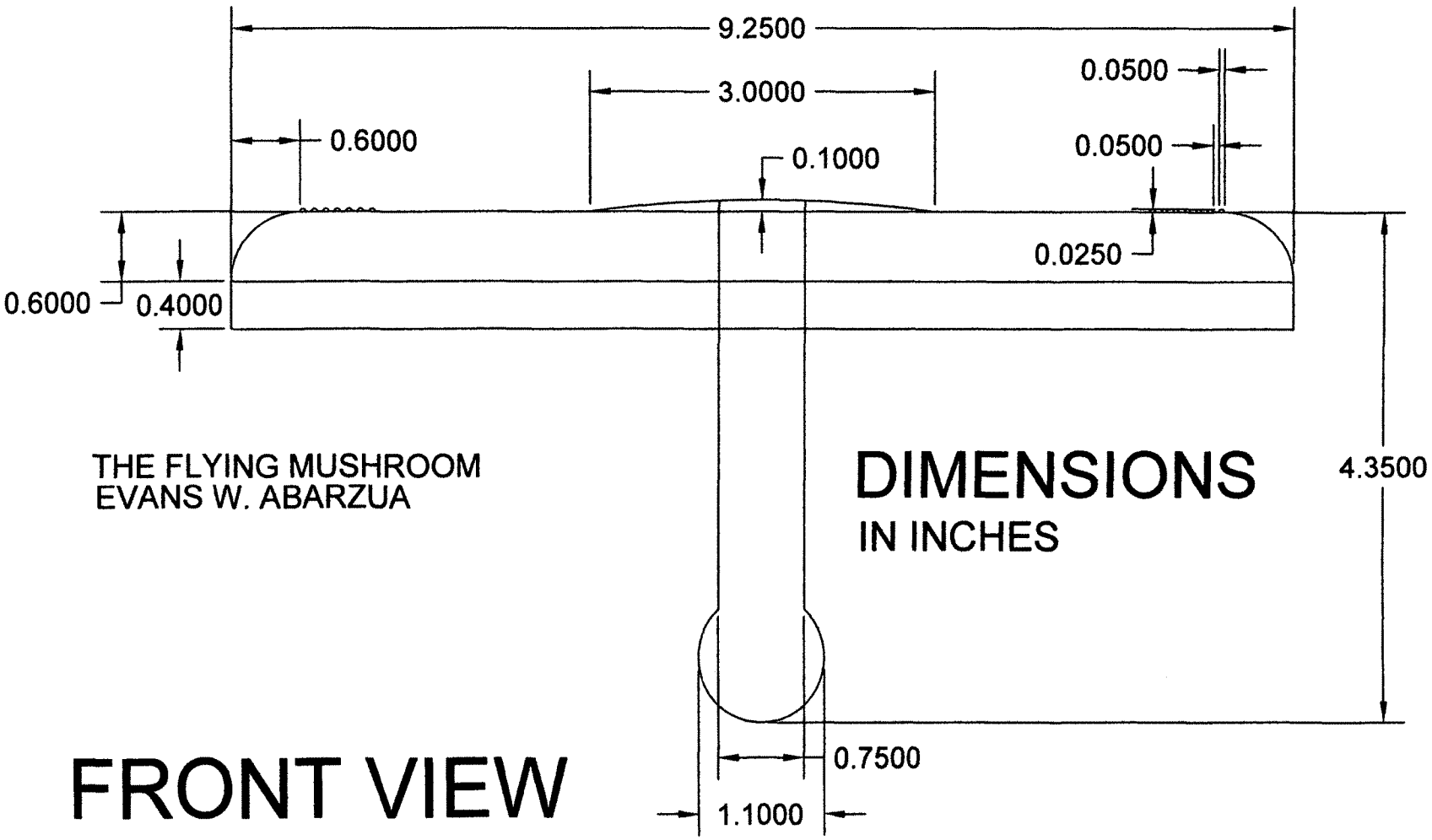
FIG. 1 Here is a front view of my flying disk. I called this one the flying mushroom but the name can change. This drawing shows dimensions, but the flying disk can come in many sizes and shapes. Here we can clearly see that it is a flying disk with a handle at the center downwards, this is what makes my invention unique. In this figure the handle is straight with a ball at the end. Also the handle can come in many sizes and shapes.
Figure 2:
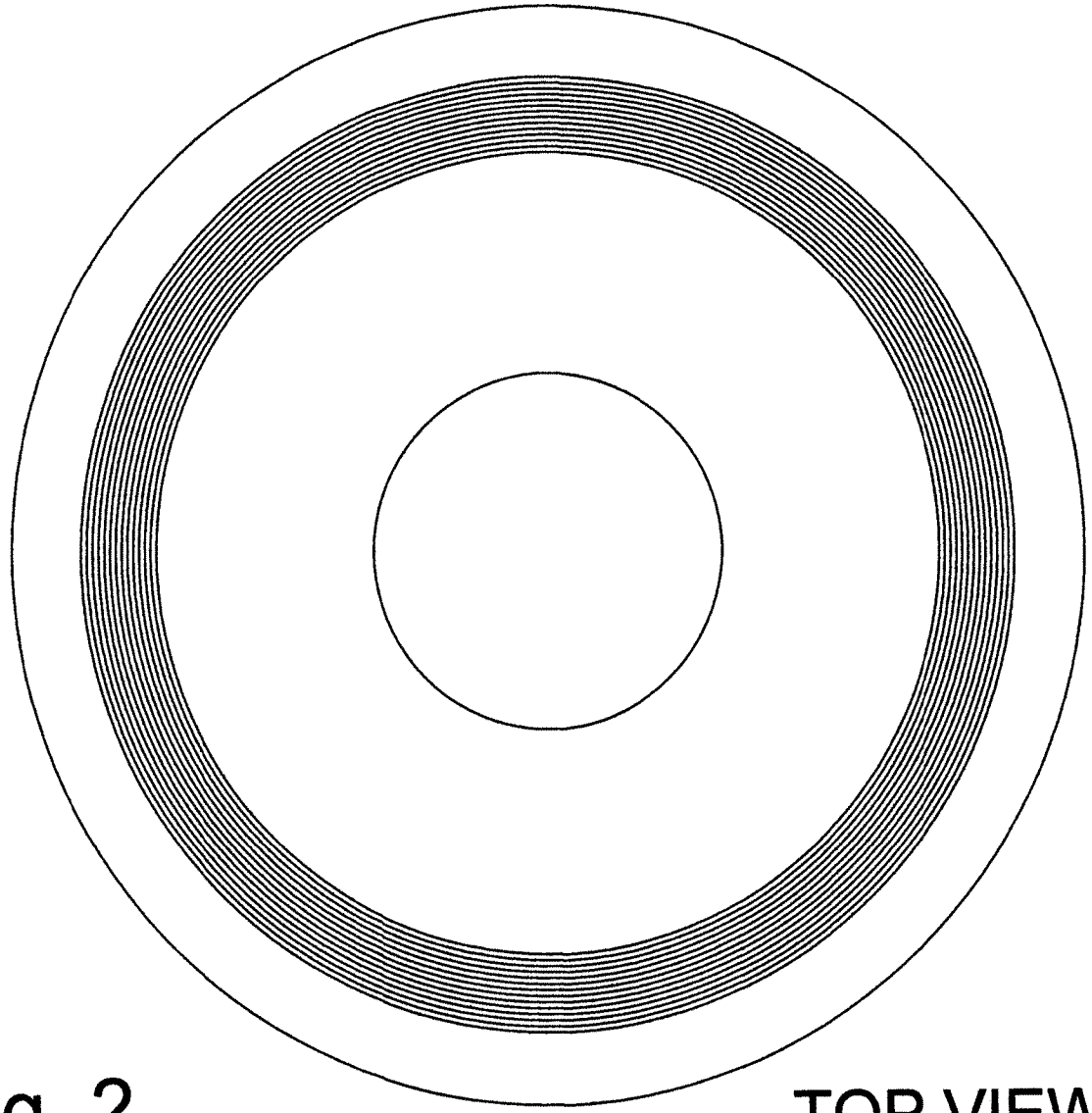
FIG. 2 shows the top view of the flying disk. It is round like any other disk. Lines can be put on top for grip or for looks.
Figure 3:
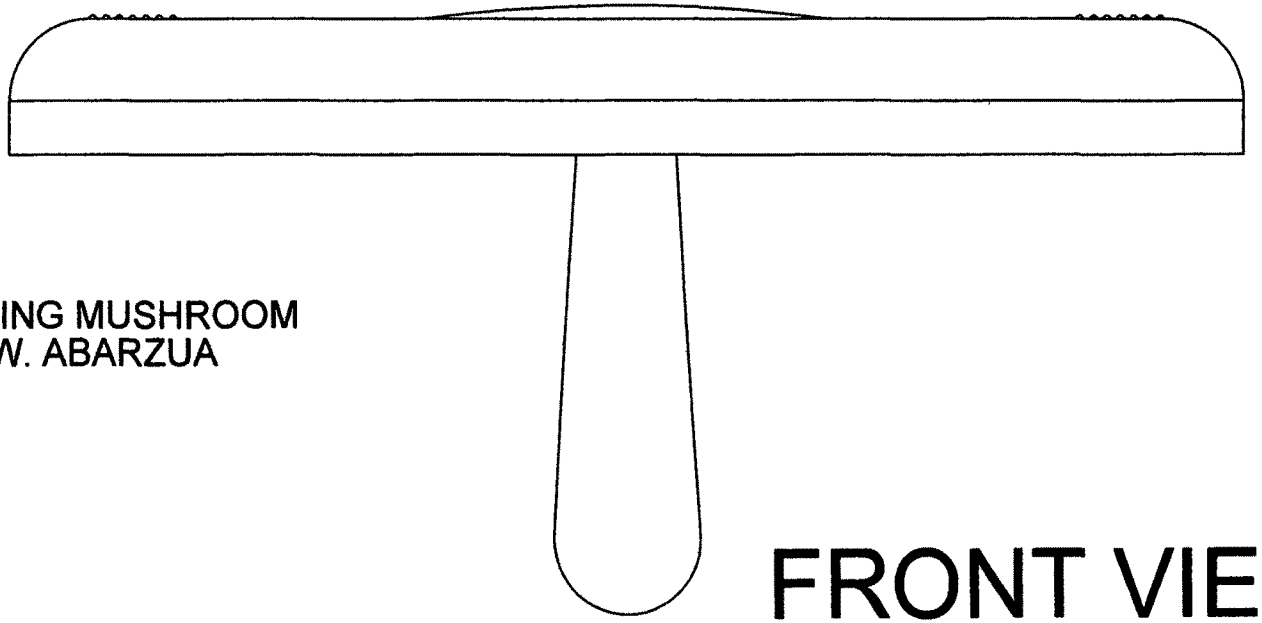
FIG. 3 Here is a front view of my flying disk with a tapered handle. The handle can start narrower at the top and wider at the bottom, or it can even start wider at the top and narrower at the bottom. This figure clearly shows the unique feature of my invention (Evans W. Abarzua) of being a flying disk with a handle at the center downwards.
Figure 4:
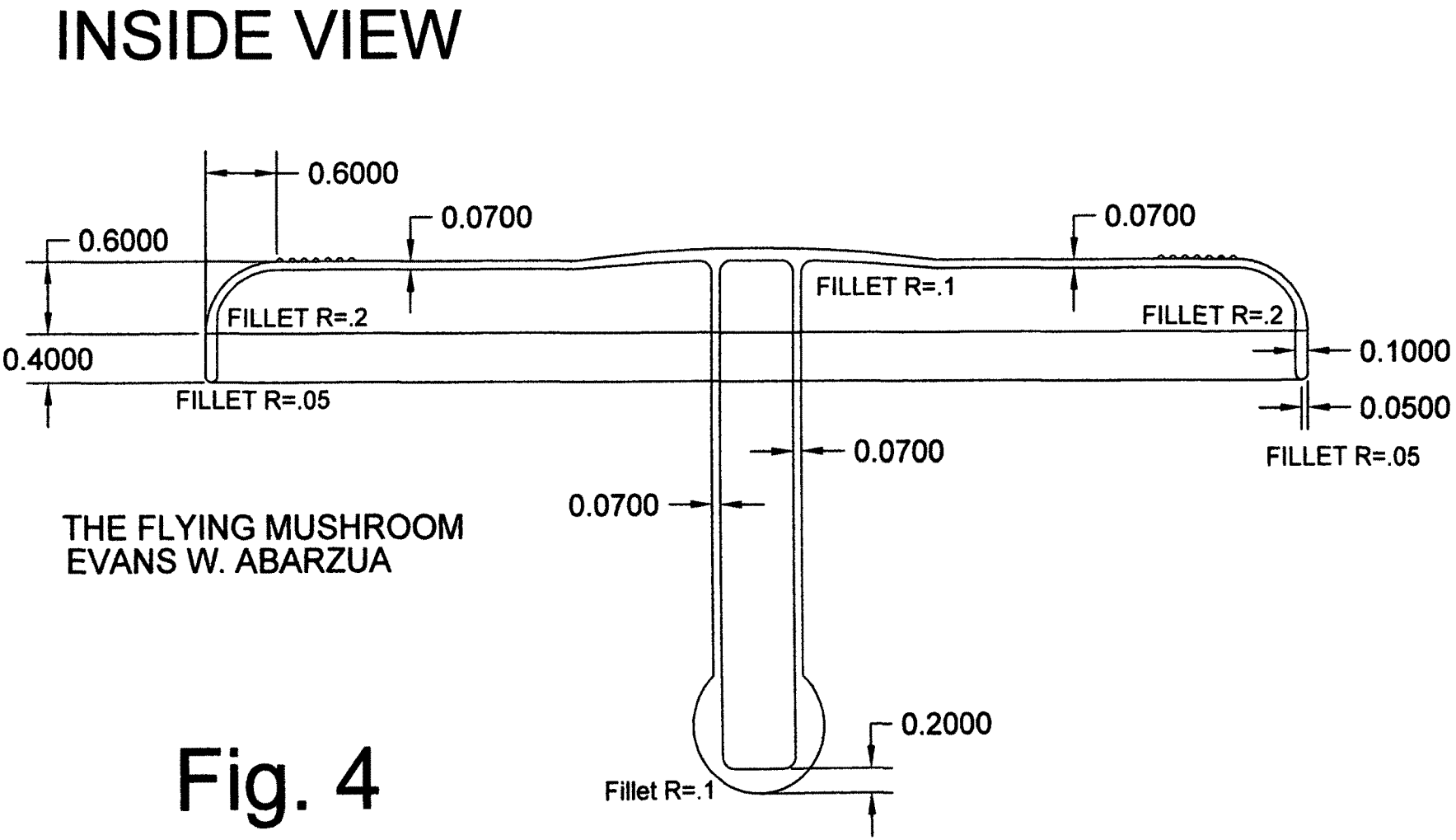
FIG. 4 shows the inside view of my invention. The handle can be hollowed or not. Again here the dimensions shown are just for this drawing, but it can come in all sizes and shapes. What really matters is that my invention is a flying disk with a handle at the center downwards.

This is a flying disk with a handle at the center downwards; this feature is what makes it unique and my own invention (Evans Walter Abarzua). It can be made with all type of plastics and materials. It is composed of a flying disk part and a handle part, both fused together to create a one piece flying disk. The handle can come in different forms, straight handle, tapered handle (larger and smaller at either end), handle with a ball at the end or any other shape. Also the handle can come with curves (concaved in and/or concaved out), and it can come with grooves. Also the handle can come in all sizes. The handle can have lights, produce sounds and carry batteries, etc.

What is claimed is:

1. A disk toy for throwing through the air and for rotating on a support surface comprising:

a solid circular plastic disk body having an upper surface, a lower surface, and a downwardly extending perimeter rim;

an integral plastic handle extending downwardly from a center of the disk body having:

a smooth outside surface;

an inside surface defining a hollow cavity within the handle;

a light and sound producing mechanism installed in the handle;

a proximal end integrally coupled to the lower surface of the disk body; and a distal end having a spherically shaped bulge;

wherein a length of the handle between the proximal end and the distal end is 4.35 inches, a width of the handle at the proximal end is smaller than a width of the handle at the distal end and a thickness between the outside surface and the inside surface of the handle adjacent the proximal end is smaller than a thickness between the outside surface and the inside surface of the handle adjacent the distal end; and wherein a thickness between the upper surface and the lower surface of the disk body adjacent the proximal end of the handle is greater than a thickness between the upper surface and the lower surface of the disk body adjacent the perimeter rim.

* * * * *